US012173917B2

(12) United States Patent
Boyd et al.

(10) Patent No.: US 12,173,917 B2
(45) Date of Patent: Dec. 24, 2024

(54) SYSTEMS AND METHODS TO OPERATE HVAC SYSTEM IN VARIABLE OPERATING MODE

(71) Applicant: Johnson Controls Tyco IP Holdings LLP, Milwaukee, WI (US)

(72) Inventors: Andrew Michael Boyd, Wichita, KS (US); Theresa Thy Nguyen Gillette, Wichita, KS (US); D Gamage Methmini Umayangana Maheshwari Sumanasekara, Wichita, KS (US); Mason Sloan Dewald, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/134,420

(22) Filed: Apr. 13, 2023

(65) Prior Publication Data

US 2023/0324070 A1 Oct. 12, 2023

Related U.S. Application Data

(63) Continuation of application No. 17/214,260, filed on Mar. 26, 2021, now Pat. No. 11,644,213.

(51) Int. Cl.

| | |
|---|---|
| ***F24F 11/65*** | (2018.01) |
| ***F24F 11/49*** | (2018.01) |
| *F24F 110/10* | (2018.01) |

(52) U.S. Cl.

CPC ..... *F24F 11/65* (2018.01); *F24F 11/49* (2018.01); *F24F 2110/10* (2018.01)

(58) Field of Classification Search

CPC ..... F24F 11/65; F24F 11/49; F24F 2110/10; F24F 11/30; F24F 11/46

See application file for complete search history.

(56) References Cited

U.S. PATENT DOCUMENTS

| | | | | |
|---|---|---|---|---|
| 5,022,460 | A | 6/1991 | Brown | |
| 5,410,230 | A | 4/1995 | Bessler et al. | |
| 5,806,760 | A * | 9/1998 | Maiello | G05D 23/1904 236/11 |
| 5,816,491 | A | 10/1998 | Berkeley et al. | |
| 6,230,979 | B1 * | 5/2001 | Vendt | G05D 23/1951 165/262 |
| 9,677,797 | B2 | 6/2017 | Havard, Jr. et al. | |
| 11,333,384 | B1 * | 5/2022 | Karimi | F24F 11/63 |
| 2005/0092317 | A1 | 5/2005 | Hugghins et al. | |

(Continued)

FOREIGN PATENT DOCUMENTS

KR 20190073870 A 6/2019

*Primary Examiner* — Alicia M. Choi
(74) *Attorney, Agent, or Firm* — Fletcher Yoder, P.C.

(57) ABSTRACT

A heating, ventilation, and/or air conditioning (HVAC) system includes secondary control circuitry configured to communicatively couple to primary control circuitry of the HVAC system that is configured to operate the HVAC system in a variable operating mode. The secondary control circuitry is configured to cause operation of the HVAC system in a calibration mode to determine a calibrated target temperature and transmit the calibrated target temperature to the primary control circuitry to enable operation of the HVAC system in the variable operating mode via the primary control circuitry based on the calibrated target temperature.

20 Claims, 7 Drawing Sheets

(56) References Cited

U.S. PATENT DOCUMENTS

| | | | | |
|---|---|---|---|---|
| 2006/0037332 | A1* | 2/2006 | Hwang | F24F 11/86 62/158 |
| 2007/0012052 | A1* | 1/2007 | Butler | F24F 11/65 62/181 |
| 2008/0028780 | A1 | 2/2008 | Song | |
| 2008/0133061 | A1* | 6/2008 | Hoglund | F24F 11/63 700/277 |
| 2010/0114382 | A1* | 5/2010 | Ha | F24F 11/62 700/276 |
| 2011/0309155 | A1 | 12/2011 | Thompson | |
| 2012/0193437 | A1 | 8/2012 | Henry, Jr. et al. | |
| 2015/0075766 | A1 | 3/2015 | Alston | |
| 2015/0114080 | A1 | 4/2015 | Berg et al. | |
| 2015/0276291 | A1 | 10/2015 | Pham et al. | |
| 2015/0285526 | A1 | 10/2015 | Smith et al. | |
| 2015/0321298 | A1 | 11/2015 | Chen et al. | |
| 2017/0089603 | A1* | 3/2017 | Bentz | F24F 11/871 |
| 2017/0268812 | A1* | 9/2017 | Trudeau | F25B 49/022 |
| 2019/0286084 | A1* | 9/2019 | Leal | F24F 11/62 |
| 2019/0316799 | A1* | 10/2019 | Bharatia | G06N 3/08 |
| 2020/0309432 | A1 | 10/2020 | Seo et al. | |
| 2021/0088239 | A1 | 3/2021 | Smith et al. | |
| 2021/0207827 | A1 | 7/2021 | Rowswell et al. | |

* cited by examiner

SYSTEMS AND METHODS TO OPERATE HVAC SYSTEM IN VARIABLE OPERATING MODE

CROSS REFERENCE TO RELATED APPLICATIONS

This application is a continuation of U.S. patent application Ser. No. 17/214,260, entitled "SYSTEMS AND METHODS TO OPERATE HVAC SYSTEM IN VARIABLE OPERATING MODE," filed Mar. 26, 2021, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. In some embodiments, the HVAC system may be configured to operate in various operating modes, such as at different capacities and/or different stages, to condition the supply air flow. Unfortunately, certain thermostats may be incompatible with existing HVAC systems configured to operate in various operating modes.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes secondary control circuitry configured to communicatively couple to primary control circuitry of the HVAC system that is configured to operate the HVAC system in a variable operating mode. The secondary control circuitry is configured to cause operation of the HVAC system in a calibration mode to determine a calibrated target temperature and transmit the calibrated target temperature to the primary control circuitry to enable operation of the HVAC system in the variable operating mode via the primary control circuitry based on the calibrated target temperature.

In one embodiment, a method for operating a heating, ventilation, and/or air conditioning (HVAC) system includes operating the HVAC system in a calibration mode to determine a calibrated target temperature and a reference run time, operating the HVAC system in a variable operating mode based on the calibrated target temperature, monitoring a duration of time associated with the operation of the HVAC system in the variable operating mode, and in response to determining that the duration of time exceeds the reference run time by a threshold period of time, operating the HVAC system in the variable operating mode based on a predetermined temperature reference value instead of based on the calibrated target temperature.

In one embodiment, a non-transitory computer-readable medium comprising instructions, wherein the instructions, when executed by processing circuitry, are configured to cause the processing circuitry to determine that a thermostat of a heating, ventilation, and/or air conditioning (HVAC) system communicatively coupled to the processing circuitry is not configured to provide select data, operate the HVAC system in a calibration mode to determine a calibrated target temperature in response to the determination that the thermostat is not configured to provide the select data, and transmit the calibrated target temperature to control circuitry of the HVAC system to enable operation of the HVAC system in a variable operating mode via the control circuitry based on the calibrated target temperature.

BRIEF DESCRIPTION OF THE DRAWINGS

Various aspects of this disclosure may be better understood upon reading the following detailed description and upon reference to the drawings in which.

DETAILED DESCRIPTION

Figure 1:
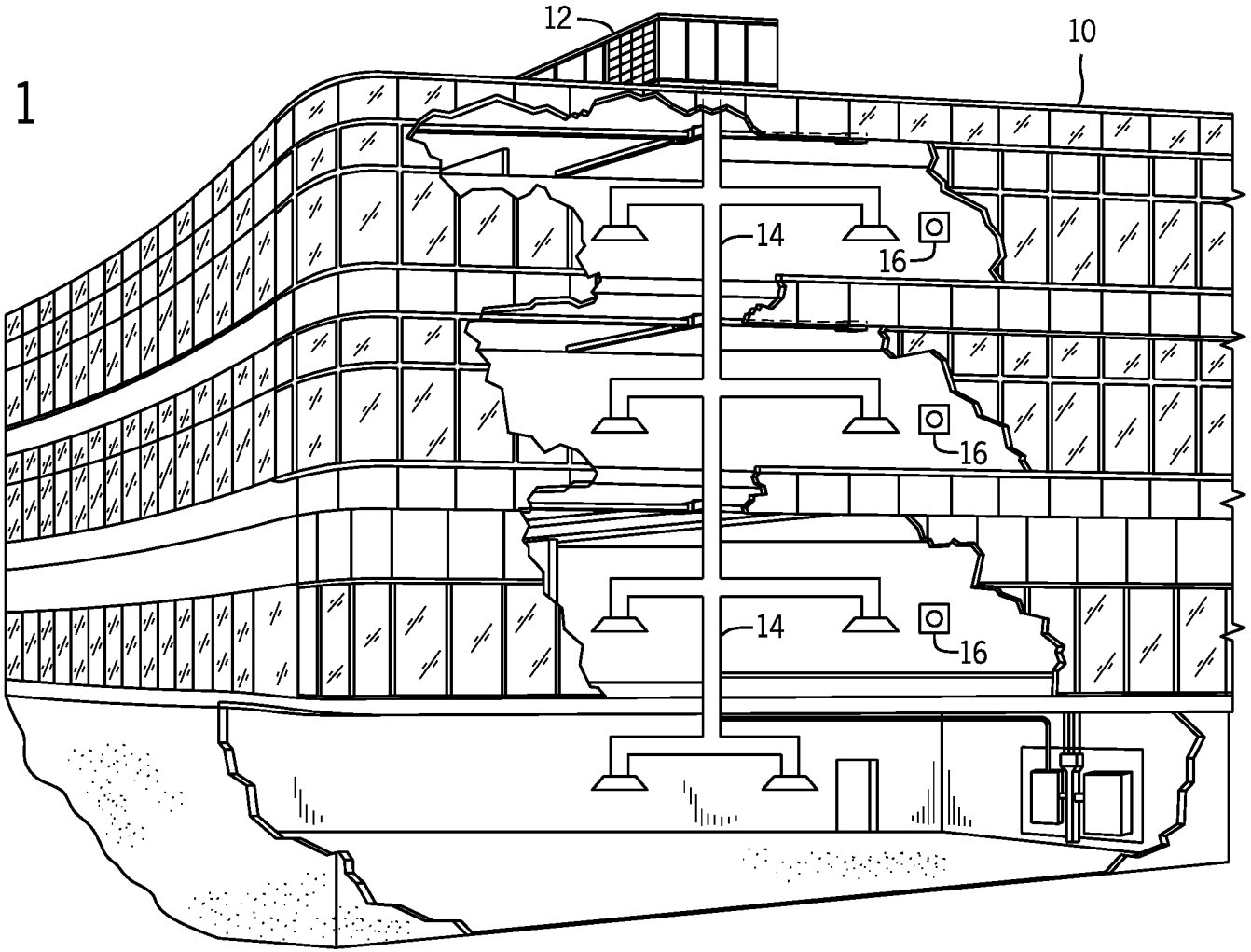
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may be configured to operate in various operating modes to condition a supply air flow and to deliver the supply air flow to a space to condition the space. For example, the HVAC system may have a compressor (e.g., in an outdoor unit) that can operate at different (e.g., variable) capacities or stages. Additionally or alternatively, the HVAC system may include a furnace (e.g., a modulating furnace) that can operate at different (e.g., variable) stages or modes. A control system (e.g., a primary control system, a primary control board, primary control circuitry) of the HVAC system may select or adjust the operating mode of the HVAC system to condition the supply air flow more efficiently or effectively, such as based on various operating parameters (e.g., a setpoint temperature) associated with the HVAC system.

In existing HVAC systems, the control system may be configured to operate the HVAC system in the various operating modes based on signals received from a thermostat. The signals may be indicative of operating parameters used for selecting or adjusting the operating mode of the HVAC system. However, certain thermostats (e.g., conventional thermostats) may not provide a portion of the signals typically utilized to adjust variable operation of the HVAC system. As a result, the control system may be unable to operate the HVAC system in various operating modes based on the signals received from such thermostats. For this reason, operation and/or performance of the HVAC system may be limited when certain thermostats are utilized with the HVAC system.

Thus, it is presently recognized that enabling the control system to operate the HVAC system in various operating modes based on signals provided by a conventional or traditional thermostat (e.g., a switching thermostat) may improve operation of the HVAC system. Accordingly, embodiments of the present disclosure are directed to control circuitry (e.g., additional control circuitry, secondary control circuitry) that enables the control system to operate in various operating modes using signals (e.g., electrical signals) transmitted by a traditional or conventional thermostat (e.g., non-communicating thermostat). For example, the control circuitry may be configured to determine whether the thermostat is a conventional (e.g., non-communicating) thermostat or a communicating thermostat. In some embodiments, the control circuitry may determine whether one or more signals transmitted by the thermostat are indicative of a type of the thermostat (e.g., communicating or non-communicating). In response to a determination that the thermostat is a conventional thermostat, the control circuitry may determine additional information and provide the additional information to the control system to enable the control system to operate the HVAC system in the various operating modes. As an example, the control circuitry may cause the HVAC system to operate in a calibrating mode to determine a value of an operating parameter that is not indicated by the signals provided by the thermostat or otherwise communicated by the thermostat. Additionally or alternatively, the control circuitry may provide a predetermined value of the operating parameter. The control system may then operate the HVAC system in the various operating modes based on such information provided by the control circuitry. As discussed in further detail below, the value or predetermined value of the operating parameter may be utilized by the control system as a substitute for data that would typically be provided by a communicating (e.g., non-conventional) thermostat. As a result, the control circuitry enables operation of the HVAC system in the various operating modes using signals from conventional, non-communicating thermostats, thereby improving performance of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
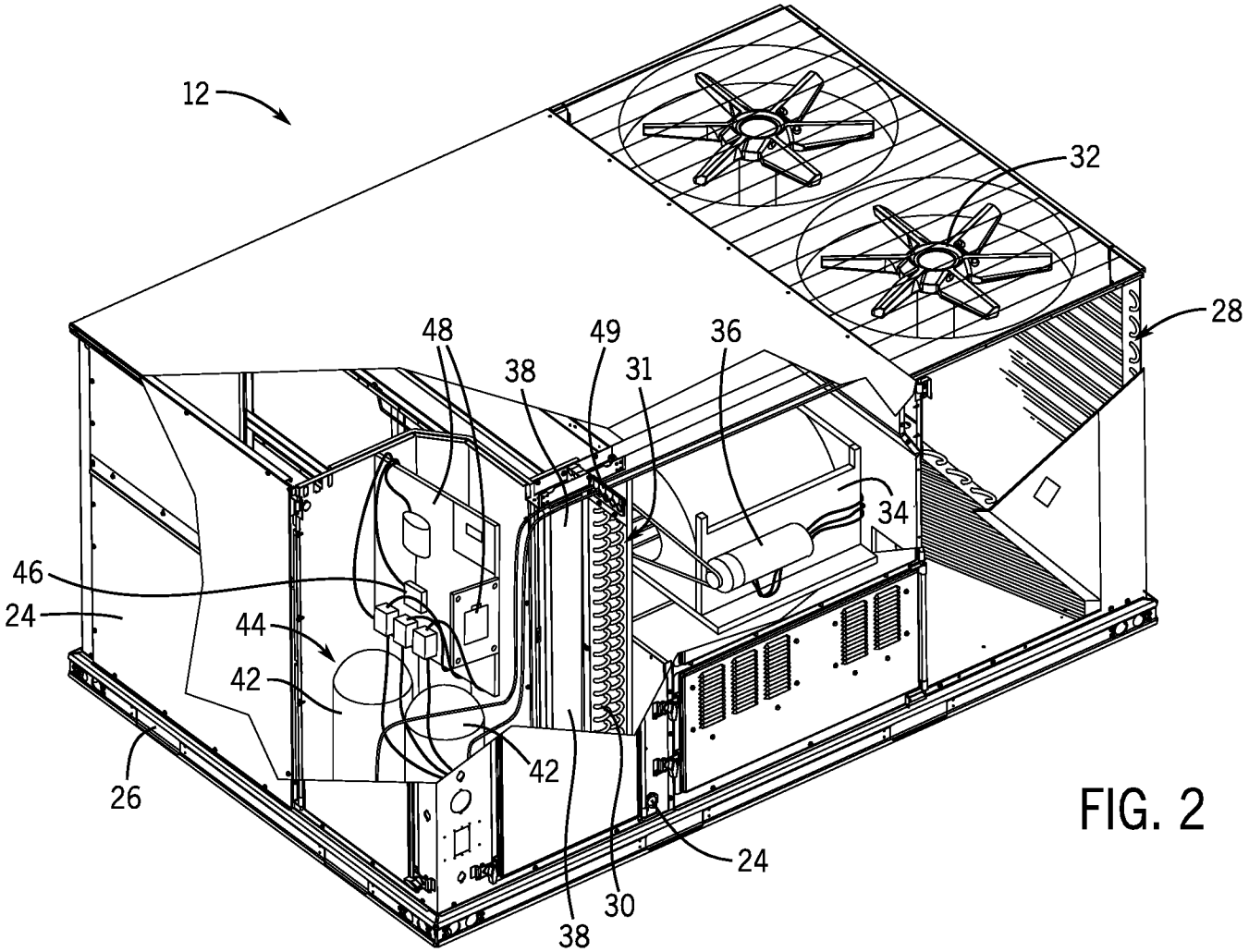
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
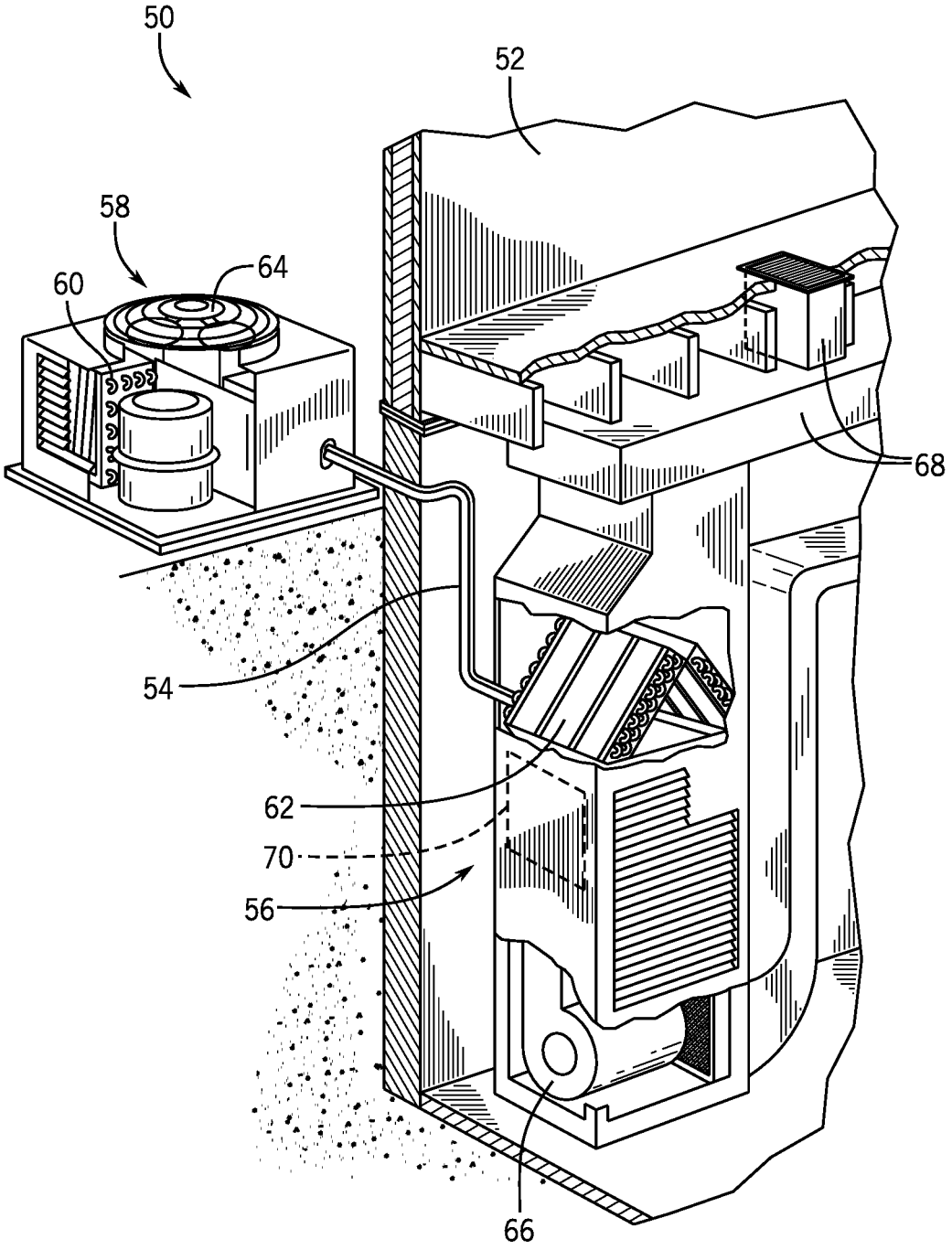
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
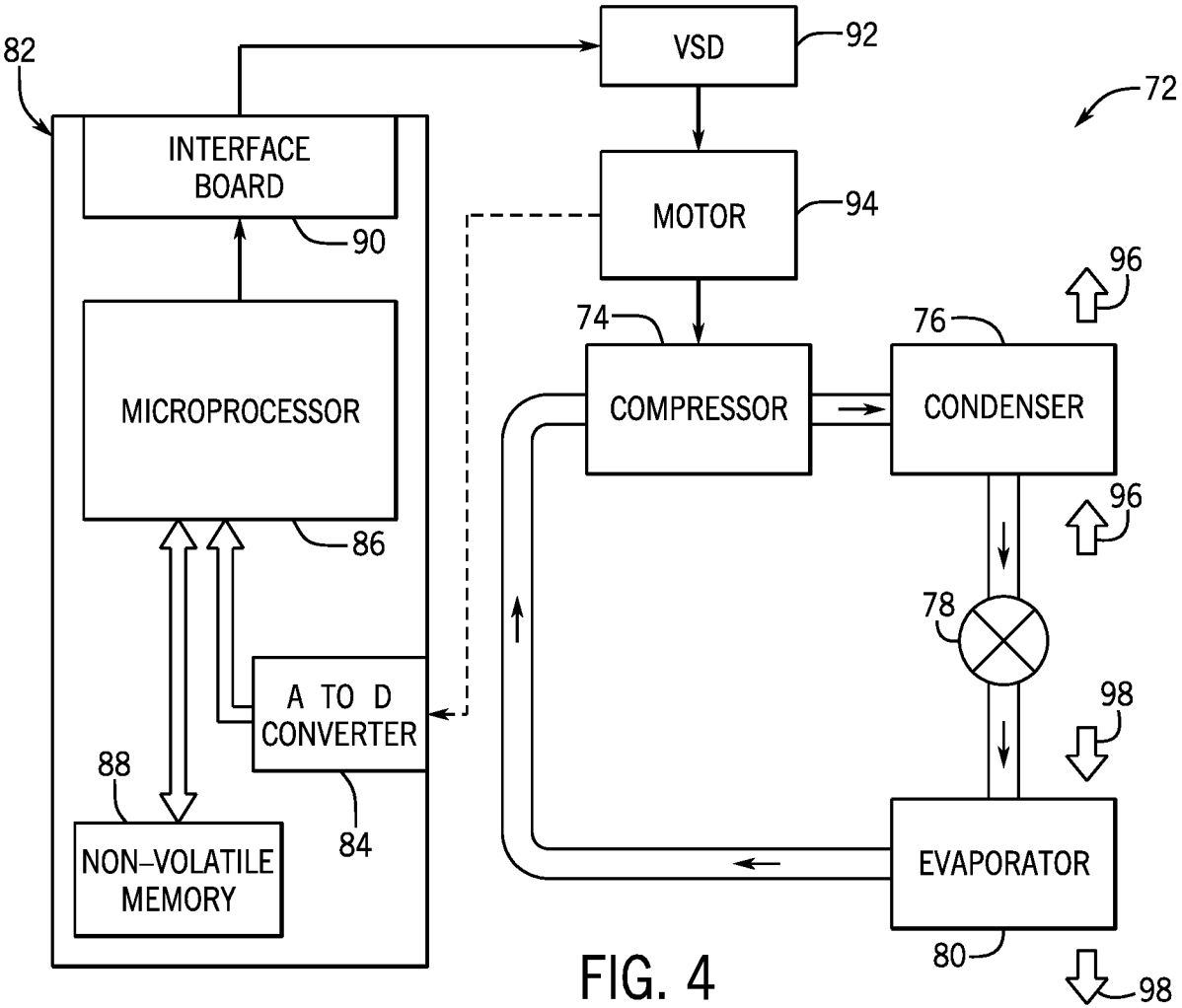
FIG. 4 is a schematic diagram of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to an HVAC system configured to operate in various operating modes. The HVAC system may include primary control circuitry that is communicatively coupled to a thermostat and configured to operate the HVAC system. For example, the primary control circuitry may be configured to operate the HVAC system based on a type of the thermostat. The HVAC system may also include secondary control circuitry configured to determine whether the thermostat is a conventional (e.g., non-communicating or switching) thermostat or a communicating thermostat. Based on the determination, the primary control circuitry may operate the HVAC system based on information provided by the secondary control circuitry and/or the thermostat to enable operation in the various operating modes. For example, in response to a determination that the thermostat is a conventional thermostat, the secondary control circuitry may provide additional data to the primary control circuitry to enable operation of the HVAC system in the various operating modes. In some embodiments, the additional data may include a calibrated and/or a predetermined value of an operating parameter that is not otherwise indicated by signals provided by the conventional thermostat. As a result, the HVAC system may be operated in the various operating modes using conventional thermostats and communicating thermostats.

Figure 5:
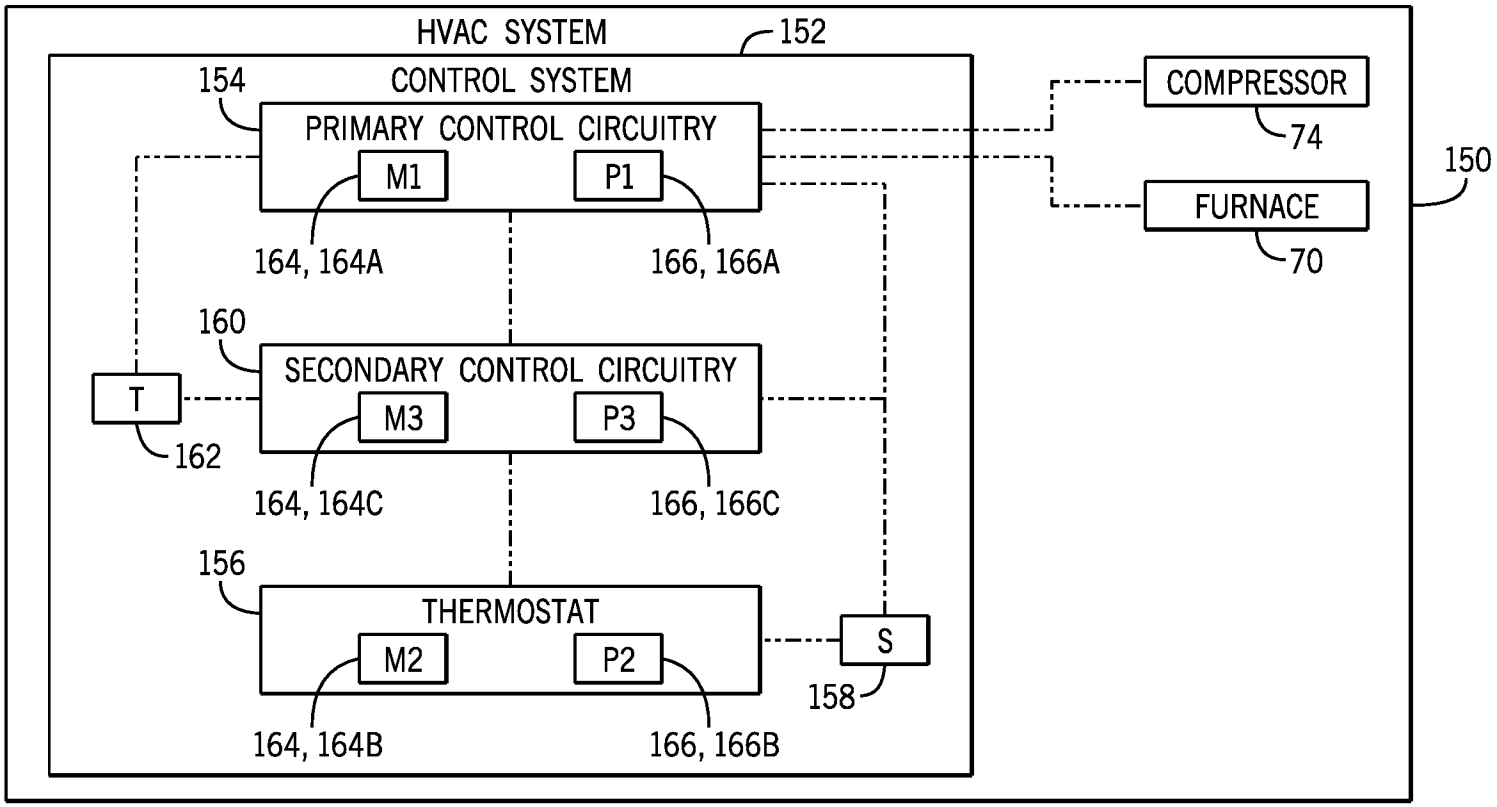
FIG. 5 is a schematic diagram of an embodiment of an HVAC system having primary control circuitry and secondary control circuitry communicatively coupled to a thermostat, in accordance with an aspect of the present disclosure.

With this in mind, FIG. 5 is a schematic diagram of an embodiment of an HVAC system 150 that includes a control system 152 configured to operate the HVAC system 150 to condition a space serviced by the HVAC system 150. For example, the HVAC system 150 may include the compressor 74 of the vapor compression system 72, and the control system 152 may include primary control circuitry 154 (e.g., an electronic controller, an electronic control board) configured to operate the compressor 74 to control cooling provided by the HVAC system 150 to the space. In some embodiments, the primary control circuitry 154 may be positioned in an outdoor unit of the HVAC system 150. Additionally or alternatively, the HVAC system 150 may include the furnace system 70, and the primary control circuitry 154 may be configured to operate the furnace system 70 to control heating provided by the HVAC system 150 to the space. In further embodiments, the primary control circuitry 154 may be configured to operate additional components of the HVAC system 150 to control conditioning of the space. For example, the primary control circuitry 154 may be configured to operate a fan, a reheat system, a valve, another suitable component, or any combination thereof. Further still, the HVAC system 150 may include a heat pump system, and the primary control circuitry 154 may be configured to operate the compressor 74 to control both cooling and heating provided by the HVAC system 150 via the compressor 74.

The primary control circuitry 154 may be configured to operate the HVAC system 150 in a variable operating mode to condition the space. As used herein, the variable operating mode includes controlling operation of the compressor 74 and/or the furnace system 70 in one of multiple available operating modes or capacities (e.g., three or more operating modes) to condition the space. That is, the primary control circuitry 154 may be configured to operate the compressor 74 and/or the furnace system in each of the operating modes in the variable operating mode, such as based on received data. As an example, the compressor 74 may be a variable speed compressor, a variable capacity compressor, a variable stage compressor, and/or a modulating compressor having multiple operating modes. As another example, the furnace system 70 may be a variable stage furnace system and/or a modulating furnace system having multiple operating modes. During the variable operating mode, the primary control circuitry 154 may select from the available operating modes and/or adjust between the available operating modes of the compressor 74 and/or of the furnace system 70 based on a desired amount of conditioning to be provided by the HVAC system 150. For instance, the primary control circuitry 154 may operate the compressor 74 and/or the furnace system 70 in a particular operating mode to efficiently and/or acutely heat, cool, and/or dehumidify the space to achieve a target operating parameter, such as a target temperature and/or a target humidity.

In some embodiments, the control system 152 may include a thermostat 156 communicatively coupled to the primary control circuitry 154. The thermostat 156 may be configured to provide one or more signals to the primary control circuitry 154, and the primary control circuitry 154 may operate the HVAC system 150 based on the signal(s). For instance, the signal(s) may indicate a call for conditioning (e.g., heating, cooling) as determined by the thermostat 156, such as based on a current condition (e.g., a current temperature, a current humidity) of the space relative to a target condition (e.g., a target temperature, a target humidity) of the space. To this end, the thermostat 156 may be communicatively coupled to one or more sensors 158 configured to determine an operating parameter of the HVAC system 150. For example, the operating parameter may be a temperature or humidity of the space, a supply air flow, a return air flow, an ambient environment, or any other suitable operating parameter. The thermostat 156 may receive data from the sensor(s) 158 indicative of the operating parameter, and the thermostat 156 may transmit the signal(s) to the primary control circuitry 154 based on the data. The thermostat 156 may additionally or alternatively transmit the signal(s) based on a user input. For example, the thermostat 156 may include a user interface, such as a touchscreen, a dial, a button, a slider, a joystick, another suitable feature, or any combination thereof, with which a user (e.g., an occupant) may interact to transmit the user input. The user input may be indicative of a desired quality of air to be provided by the HVAC system 150, of a desired operating parameter (e.g., temperature or humidity) of the space serviced by the HVAC system 150, and/or of a desirable operating mode of the HVAC system 150, and the thermostat 156 may transmit the signal(s) based on the user input to cause the primary control circuitry 154 to operate in one of the available variable operating modes.

The primary control circuitry 154 may enable operation of the HVAC system 150 based on a received signal indicative of the call for conditioning, such as by adjusting the operating mode of the compressor 74 and/or of the furnace system 70, until the thermostat 156 indicates that the call for conditioning has been satisfied. As an example, while the HVAC system 150 is in operation, the thermostat 156 may monitor the condition of the space (e.g., via the sensor(s) 158) and determine whether conditioning of the space is to be continued. Based on a determination that the space is to be conditioned, the thermostat 156 may continue to transmit feedback, data, or signals to the primary control circuitry 154 to cause the primary control circuitry 154 to operate the HVAC system 150 to condition the space. Based on a determination that the call for conditioning has been satisfied (e.g., the target condition of the space has been achieved), the thermostat 156 may interrupt or suspend transmission of the signals and/or feedback to the primary control circuitry 154. As a result, the primary control circuitry 154 may suspend operation of the HVAC system 150 to discontinue conditioning of the space.

However, in certain embodiments, the thermostat 156 may be a conventional (e.g., switching or non-communicating) thermostat, and the conventional thermostat may not be configured to provide information (e.g., data, feedback) that enables the primary control circuitry 154 to cause operation in each of the operating modes of the compressor 74 and/or of the furnace system 70. For instance, the primary control circuitry 154 may be configured to operate the HVAC system 150 in the variable operating mode, such as by selecting from one of the available operating modes, based on information (e.g., communications) transmitted by certain embodiments of the thermostat 156 (e.g., non-conventional thermostats, communicating thermostats). The data typically transmitted by such thermostats 156 may include information related to multiple operating parameters of the HVAC system 150 (e.g., detected by multiple sensors 158). Such operating parameters may include a temperature (e.g., a suction temperature, a discharge temperature) of refrigerant directed through the HVAC system 150, a pressure (e.g., a suction pressure, a discharge pressure) of the refrigerant, an operation (e.g., an operating speed) of the compressor 74, a position of a valve (e.g., the expansion valve 78), a temperature, pressure, humidity, or flow rate of air (e.g., a supply air flow conditioned by the HVAC system 150, a return air flow received by the HVAC system 150, ambient or outdoor air used for cooling the refrigerant), another suitable operating parameter, or any combination thereof. However, conventional thermostats may not be configured to provide some or all of the operating parameters used by the primary control circuitry 154 to operate in the variable operating mode. Thus, the primary control circuitry 154 may not be able to operate the HVAC system 150 in the variable operating mode via the conventional thermostat.

By way of example, the thermostat 156 may be communicatively coupled to a single sensor 158 and configured to transmit signal(s) (e.g., a 24 voltage signal) based on data received from the sensor 158. The primary control circuitry 154 may not be configured to operate the HVAC system 150 in the variable operating mode based on such signals transmitted from the thermostat 156. For instance, certain operating modes of the compressor 74 and/or of the furnace 70 may be unavailable (e.g., the primary control circuitry 154 may simply operate the HVAC system 150 as a single stage or a 2-stage system). As an example, the signal(s) transmitted by the thermostat 156 may indicate a call for conditioning (e.g., heating, cooling) to be provided by the HVAC system 150 without indicating a particular operating parameter value used by the primary control circuitry 154 to operate the HVAC system 150 in the variable operating mode. Thus, operation of the HVAC system 150 may be limited using such embodiments of the thermostat 156.

For this reason, the control system 152 may also include secondary control circuitry 160, in accordance with presently-disclosed techniques. The secondary control circuitry 160 may include an electronic controller or control board (e.g., auxiliary electronic control circuitry). In some embodiments, the secondary control circuitry 160 is physically separate from the primary control circuitry 154 and/or the thermostat 156 and may be communicatively coupled to the primary control circuitry 154 and/or the thermostat 156 via a physical connection (e.g., wiring, connectors) and/or a wireless connection. Additionally or alternatively, the secondary control circuitry 160 may include hardware or software that is incorporated within the thermostat 156 and/or the primary control circuitry 154. That is, the thermostat 156 and/or the primary control circuitry 154 may be modified to incorporate the secondary control circuitry 160, and the secondary control circuitry 160 may therefore be integral to the thermostat 156 and/or the primary control circuitry 154. The secondary control circuitry 160 may be positioned in the outdoor unit, an indoor unit of the HVAC system 150, or in another suitable location.

The secondary control circuitry 160 may be configured to determine and/or provide additional data to the primary control circuitry 154 to enable the primary control circuitry 154 to operate the HVAC system 150 in the variable operating mode when the thermostat 156 is a conventional thermostat. For example, the secondary control circuitry 160 may determine a type of the thermostat 156 (e.g., based on data, feedback, signal(s) transmitted by the thermostat 156) to determine whether the primary control circuitry 154 may operate the HVAC system 150 in the variable operating mode without receiving the additional data from the secondary control circuitry 160. Based on a determination that the thermostat 156 is a conventional thermostat, the secondary control circuitry 160 may transmit one or more signals to the primary control circuitry 154 to provide additional information that enables operation of the HVAC system 150 in the variable operating mode via the primary control circuitry 154. In certain embodiments, the additional information may include calibrated information determined based on operation of the HVAC system 150 in a calibrated mode. In additional or alternative embodiments, the additional information may include predetermined or preset information. The primary control circuitry 154 may operate the HVAC system 150 based on the calibrated information and/or the predetermined information received from the secondary control circuitry 160. Thus, the secondary control circuitry 160 may enable operation of the HVAC system 150 in the variable operating mode when the thermostat 156 is a conventional thermostat to improve a performance (e.g., an efficiency) of the HVAC system 150.

Although the present disclosure primarily discusses the secondary control circuitry 160 determining the type of the thermostat 156, in additional or alternative embodiments, the primary control circuitry 154 may determine the type of the thermostat 156 (e.g., based on data, feedback, signal(s) transmitted by the thermostat 156). Based on a determination that the type of the thermostat 156 is a conventional thermostat, the primary control circuitry 154 may then instruct the secondary control circuitry 160 to provide the additional information to the primary control circuitry 154 to enable operation of the HVAC system 150 in the variable operating mode. For example, the primary control circuitry 154 may transmit one or more signals to the secondary control circuitry 160 that causes the secondary control circuitry 160 to determine the calibrated information and transmit the calibrated information to the primary control circuitry 154 and/or to transmit the predetermined information to the primary control circuitry 154.

In certain embodiments, the secondary control circuitry 160 may also receive input from the thermostat 156 (e.g., at least one signal) and determine a type of call for conditioning indicated by the input. The secondary control circuitry 160 may transmit the additional information to the primary control circuitry 154 based on the type of call for conditioning. As an example, the additional information provided by the secondary control circuitry 160 may be indicative of temperature data 162. Thus, the primary control circuitry 154 may use data or information (e.g., signals) provided by the thermostat 156 (e.g., indicative of data received from the sensor(s) 158) and the temperature data 162 to operate the HVAC system 150 in the variable operating mode. By way of example, the signals provided by the thermostat 156 may be indicative of a current temperature of the space, such as a temperature value of a return air flow directed from the space into the HVAC system 150, and the temperature data 162 may be representative of or a substitute of a setpoint or target temperature of the space.

In some embodiments, the primary control circuitry 154 may continue to receive the signal(s) transmitted by the thermostat 156 (e.g., receive the signal(s) directly from the thermostat 156, receive the signal(s) from the thermostat 156 via the secondary control circuitry 160). In such embodiments, the primary control circuitry 154 may compare the temperature data 162 with the signal(s) received from the thermostat 156 to operate the HVAC system 150 accordingly. Additionally or alternatively, the secondary control circuitry 160 may receive the signal(s) from the thermostat 156 and generate a corresponding one or more signals based on the received signal(s). The secondary control circuitry 160 may then transmit the generated signal(s) to the primary control circuitry 154 as the temperature data 162 to enable the primary control circuitry 154 to operate the HVAC system 150 accordingly. That is, in such embodiments, the primary control circuitry 154 may operate the HVAC system 150 based on the temperature data 162 without receiving the signal(s) transmitted by the thermostat 156. The primary control circuitry 154 may operate the compressor 74 and/or the furnace system 70 in a particular operating mode based on the temperature data 162 and/or the signal(s) transmitted by the thermostat 156 (e.g., signal(s) transmitted directly from the thermostat 156 to the primary control circuitry 154, signal(s) transmitted from the thermostat 156 to the primary control circuitry 154 via the secondary control circuitry 160, signal(s) generated by the secondary control circuitry 160 based on the signal(s) transmitted by the thermostat 156) to condition the space more efficiently and/or acutely via the variable operating mode.

Although the present disclosure primarily discusses the thermostat 156 as providing the current temperature of the space and the secondary control circuitry 160 as providing data representative of the target temperature of the space (e.g., data substituting a user input indicative of a setpoint temperature of the space), the signal(s) provided by the thermostat 156 and/or the additional information provided by the secondary control circuitry 160 may be representative of a different operating parameter associated with an air flow or other parameter of the HVAC system 150 in additional or alternative embodiments. In an example, the signal(s) transmitted by the thermostat 156 may be indicative of a temperature of a supply air flow provided to the space or a temperature of the air flow at a different location in the HVAC system 150. In a further example, the operating parameter may be associated with another component or feature of the HVAC system 150, such as of the refrigerant, of the compressor 74, of a valve, and the like.

In embodiments in which the thermostat 156 is a non-conventional thermostat, the primary control circuitry 154 may not receive the temperature data 162 from the secondary control circuitry 160. For example, the secondary control circuitry 160 may determine a type of the thermostat 156 to determine whether the primary control circuitry 154 may operate the HVAC system 150 in the variable operating mode without receiving the additional data from the secondary control circuitry 160. As an example, the secondary control circuitry 162 may determine (e.g., based on feedback, data, signals transmitted by the primary control circuitry 154) that the primary control circuitry 154 may operate the HVAC system 150 in the variable operating mode without receiving the additional data from the secondary control circuitry 160. Thus, operation of the secondary control circuitry 160 may be suspended. As another example, the control system 152 may include the primary control circuitry 154 and not the secondary control circuitry 160. In such embodiments, the primary control circuitry 154 may operate the HVAC system 150 based on communications with the thermostat 156.

Each of the primary control circuitry 154, the thermostat 156, and the secondary control circuitry 160 may include a respective memory and processing circuitry. That is, the primary control circuitry 154 may include a first memory 164A and processing circuitry 166A, the thermostat 156 may include a second memory 164B and processing circuitry 166B, and the secondary control circuitry may include a third memory 164C and processing circuitry 166C. Each of the memories 164 may include a tangible, non-transitory, computer-readable medium that may store instructions that, when executed by the corresponding processing circuitry 166, may cause the processing circuitry 166 to perform various functions or operations described herein. To this end, each of the processing circuitries 166 may be any suitable type of computer processor or microprocessor capable of executing computer-executable code, including but not limited to one or more field programmable gate arrays (FPGA), application-specific integrated circuits (ASIC), programmable logic devices (PLD), programmable logic arrays (PLA), and the like. As an example, the respective memories 164 and processing circuitries 166 may communicate with one another to cause the control system 152 to operate the HVAC system 150 in the variable operating mode, such as by causing the primary control circuitry 154 to operate the compressor 74 and/or the furnace system 70.

Each of FIGS. 6 and 7 described below illustrates a method or process associated with operating the HVAC system 150 in the variable operating mode. In some embodiments, each of the methods may be performed by a single respective component or system, such as by the processing circuitry 166C of the secondary control circuitry 160. In additional or alternative embodiments, multiple components or systems may perform the procedures for a single one of the methods. It should also be noted that additional procedures or steps may be performed with respect to the described methods. Moreover, certain procedures or steps of the depicted methods may be removed, modified, and/or performed in a different order. Further still, the procedures or steps of any of the respective methods may be performed in parallel with one another, such at the same time and/or in response to one another.

Figure 6:
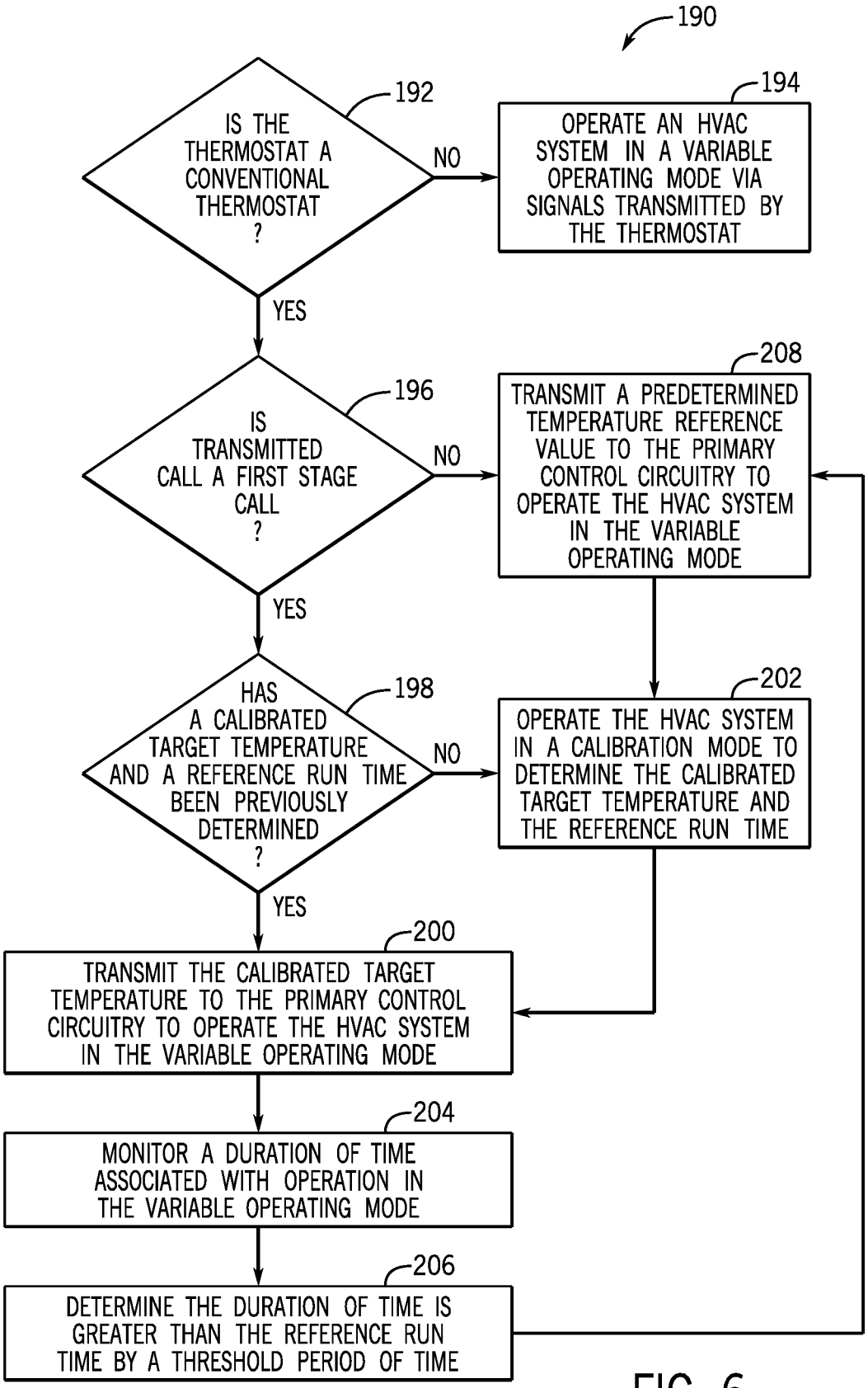
FIG. 6 is a flowchart of an embodiment of a method or process for operating an HVAC system in a variable operating mode, in accordance with an aspect of the present disclosure.

FIG. 6 is a flowchart of an embodiment of a method or process 190 that may be implemented or executed by the control system 152 to operate the HVAC system 150 in the variable operating mode. In particular, the method 190 includes steps to determine and provide data (e.g., via the secondary control circuitry 160) to the primary control circuitry 154 to enable operation of the HVAC system 150 in the variable operating mode. In the manner discussed below, the method 190 may be executed in embodiments of the HVAC system 150 having conventional thermostats and non-conventional (e.g., communicating) thermostats.

First, at block 192, a determination is made regarding whether the thermostat 156 is a conventional thermostat (e.g., the thermostat 156 is not configured to transmit certain information). Indeed, such a determination may indicate whether data from a subset of the sensor(s) 158 is unavailable via signal(s) transmitted by the thermostat 156. The determination regarding the type of the thermostat 156 may be based on one or more signals transmitted by the thermostat 156 (e.g., a type of the signal(s)), a user input, a setting (e.g., DIP switch setting) of the primary control circuitry 154 or the secondary control circuitry 160, or another suitable input.

At block 194, in response to a determination that the thermostat 156 is not a conventional thermostat (e.g., the thermostat 156 is a communicating thermostat), the HVAC system 150 is enabled to operate in the variable operating mode via the signal(s) transmitted by the thermostat 156. That is, such a determination is indicative that data enabling operation in the variable operating mode is available from the sensor(s) 158 and the thermostat 156. Indeed, the signal(s) may indicate various information, such as multiple operating parameter values, which the primary control circuitry 154 may use to operate the HVAC system 150 in the variable operating mode. Thus, the primary control circuitry 154 may operate the HVAC system 150 without receiving additional data (e.g., the temperature data 162 transmitted by the secondary control circuitry 160). In some embodiments, operation of the secondary control circuitry 160 may be suspended (e.g., the secondary control circuitry 160 may be shut down or bypassed) to reduce energy consumption while enabling the HVAC system 150 to operate in the variable operating mode via the primary control circuitry 154. In such embodiments, the primary control circuitry 154 may directly receive the signal(s) from the thermostat 156 and operate the HVAC system 150 in the variable operating mode based the signal(s). In additional or alternative embodiments, the secondary control circuitry 160 may receive the signal(s) from the thermostat 156 and may transmit the received signal(s) to the primary control circuitry 154. In other words, the primary control circuitry 154 may receive the signal(s) from the thermostat 156 via the secondary control circuitry 160. The primary control circuitry 154 may then operate the compressor 74 and/or the furnace system 70 in each of multiple operating modes based on the signal(s) provided by the thermostat 156. Indeed, the primary control circuitry 154 may select a particular operating mode based on the information indicated by the signal(s) to efficiently and effectively condition the space.

However, if the thermostat 156 is a conventional thermostat, the thermostat 156 may not be configured to provide select data or information (e.g., a setpoint or target temperature of the space). The unavailability of such data may typically inhibit operation of the HVAC system 150 in the variable operating mode via the primary control circuitry 154. For instance, the primary control circuitry 154 may not be configured to operate the compressor 74 and/or of the furnace system 70 in each of multiple operating modes via the signal(s) transmitted by conventional thermostats. By way of example, the signal(s) may not include certain operating parameter values. Rather, the signal(s) may indicate whether a call for conditioning is a first stage call, which may indicate a reduced operation for conditioning, or a second stage call, which may indicate an increased operation for conditioning. For instance, the signal(s) may indicate the first stage call based on a relatively small difference between a current condition of the space and a target condition of the space. Thus, the target condition of the space may be achieved via the reduced operation of the HVAC system 150. Further, the signal(s) may indicate a second stage call based on a relatively large difference between the current condition of the space and the target condition of the space. In such circumstances, the target condition of the space may not be adequately achieved via the reduced operation of the HVAC system 150. As such, the HVAC system may be operated in the increased operation.

Based on a determination that the thermostat 156 is a conventional thermostat (e.g., the thermostat 156 is not configured to provide the select data), the method 190 proceeds to block 196 instead of block 194. At block 196, the signal(s) transmitted by the thermostat 156 may be identified as a call for conditioning, and a determination may be made regarding whether the call for conditioning indicated by the signal(s) is a first stage call. In response to a determination that the signal(s) is indicative of a first stage call, a determination may be made regarding whether a calibrated target or setpoint temperature and a reference run time have been previously determined, as described at block 198. The calibrated target temperature and/or the reference run time may be determined (e.g., via the secondary control circuitry 160) and then used to operate the HVAC system 150 in the variable operating mode. In some embodiments, the calibrated target temperature may include a temperature value representative of or a substitute of a setpoint or desirable temperature of the space. In additional or alternative embodiments, the calibrated target temperature may include a temperature differential (e.g., indicative of a difference between a current temperature of the space and a setpoint temperature of the space). The reference run time may be indicative or representative of a previous run time (e.g., an average previous run time) of the HVAC system 150 operating to satisfy calls for conditioning.

At block 200, in response to a determination that a calibrated target temperature and a reference run time have been previously determined, the previously determined calibrated target temperature may be transmitted to the primary control circuitry 154 (e.g., as the temperature data 162) to enable operation of the HVAC system 150 in the variable operating mode via the primary control circuitry 154. The primary control circuitry 154 may use the calibrated target temperature to operate the compressor 74 and/or the furnace system 70 in the particular operating mode (e.g., operating capacity) to condition the space. For example, the primary control circuitry 154 may operate at one of a plurality of available operating capacities based on a comparison of the calibrated target temperature provided by the secondary control circuitry 160 and a measured temperature of the conditioned space provided by the thermostat 156 (e.g., a measured temperature of a return air flow). In certain embodiments, the primary control circuitry 154 may also receive the signal(s) transmitted by the thermostat 156 to operate the HVAC system 150 in the variable operating mode. In additional or alternative embodiments, the primary control circuitry 154 may operate the HVAC system 150 in the variable operating mode based on the calibrated target temperature without receiving the signal(s) transmitted by the thermostat 156.

At block 202, in response to a determination that a calibrated target temperature and a reference run time have not been previously determined, the HVAC system 150 may be operated in a calibration mode in order to determine the calibrated target temperature and reference run time. A new calibrated target temperature and reference run time may be determined based on operation of the HVAC system 150 (e.g., to provide cooling or heating) in the calibration mode, as described further below with reference to FIG. 7. The new calibrated target temperature may be stored (e.g., in memory 164C) for reference during operation of the HVAC system 150. For example, the new calibrated target temperature may be transmitted to the primary control circuitry (e.g., as the temperature data 162) to enable operation of the HVAC system 150 in the variable operating mode via the primary control circuitry 154, as described at block 200.

At block 204, a duration of time associated with operation of the HVAC system 150 in the variable operating mode using the calibrated target temperature and reference run time may be monitored. For example, the HVAC system 150 may operate in the variable operating mode with reference to the calibrated target temperature and the reference run time until a call for conditioning has been satisfied (e.g., the thermostat 156 no longer outputs a call for conditioning). Thereafter, operation of the HVAC system 150 may be suspended. The duration of time may indicate how long the HVAC system 150 has operated in the variable operating mode via the primary control circuitry 154 based on the calibrated target temperature to satisfy the call for conditioning. The duration of time may be compared to the reference run time determined via the step described with respect to block 202. In response to a determination that the duration of time does not exceed the reference run time by a threshold period of time and/or by a threshold amount (e.g., percentage of the reference run time), no further action may be taken with respect to the calibrated target temperature. For instance, the calibrated target temperature may remain stored (e.g., in memory 164C) for reference during subsequent operation of the HVAC system 150. In some embodiments, such a determination may indicate that operation of the HVAC system 150 in the variable operating mode via the primary control circuitry 154 based on the calibrated target temperature may sufficiently and/or efficiently satisfy the call for conditioning. As such, when a subsequent first stage call is identified (e.g., as described with respect to block 196), the same calibrated target temperature (e.g., stored in the memory 164C) may be transmitted to the primary control circuitry 154 to operate the HVAC system 150 in the variable operating mode without operating the HVAC system 150 in a subsequent calibration mode to determine an updated calibrated target temperature.

However, as indicated at block 206, a determination may be made that the duration of time exceeds the reference run time by the threshold period of time and/or by the threshold amount. Such a determination may indicate that the operation of the HVAC system 150 in the variable operating mode based on the calibrated target temperature does not satisfy the call for conditioning as desired. By way example, the operating mode of the compressor 74 and/or of the furnace system 70 as selected by the primary control circuitry 154 based on the calibrated target temperature may not adequately condition the space (e.g., condition the space within a desired or adequate amount of time). For instance, an event may have occurred (e.g., an adjustment in a setpoint temperature of the space, a change in a thermal resistance of the space, a change to a component of the HVAC system 150) since a previous call for conditioning was output by the thermostat 156, and the event may affect operation of the HVAC system 150 in the variable operating mode to satisfy a call for conditioning. Based on the determination in block 206, it may be desirable to determine an updated calibrated target temperature and reference run time to improve operation of the HVAC system 150 in the variable operating mode.

In response to the determination made at block 206, a predetermined temperature reference value may be transmitted to the primary control circuitry 154, as indicated at block 208. The primary control circuitry 154 may operate the HVAC system 150 in the variable operating mode based on the predetermined temperature reference value instead of based on the previously determined calibrated target temperature. The predetermined temperature reference value may cause an increased operation (e.g., a full capacity operation or an upper threshold operation) of the HVAC system 150 in the variable operating mode. By way of example, the predetermined temperature reference value may cause the primary control circuitry 154 to operate the compressor 74 and/or the furnace system 70 at a greater stage, a greater speed, a greater capacity, and the like, in order to satisfy the call for conditioning the space.

To this end, in some embodiments, the predetermined temperature reference value may be representative of and/or a substitute value for a temperature differential between a current temperature of the space and a setpoint temperature of the space (e.g., a temperature differential greater than a difference between the previously determined calibrated target temperature and a measured temperature of the space). For example, the predetermined temperature reference value may be representative of a three degrees Fahrenheit (F), four degrees F., five degrees F., or six or more degrees F. difference between a current temperature of the space and a setpoint temperature of the space. In additional or alternative embodiments, the predetermined temperature reference value may be representative of and/or a substitute value for a temperature value that is a threshold amount (e.g., three degrees F., four degrees F., five degrees F., or six or more degrees F.) different than a current temperature of the space. For instance, the predetermined temperature reference value may be a temperature value that is less than the current temperature of the space by the threshold amount to satisfy a call for cooling and/or a temperature value that is greater than the value of the current temperature of the space by the threshold amount to satisfy a call for heating. Using the predetermined temperature reference value, the HVAC system 150 may continue operation in the variable operating mode via the primary control circuitry 154 to satisfy the call for conditioning.

After the call for conditioning is satisfied via operation of the HVAC system 150 in the variable operating mode based on the predetermined temperature reference value, the HVAC system 150 may be operated in the calibration mode again, as indicated at block 202, to determine an updated calibrated target temperature and an updated reference run time. That is, in response to a determination that a most recent operation of the HVAC system 150 is operation in the variable operating mode based on the predetermined temperature reference value, the HVAC system 150 may be operated in the calibration mode to re-calibrate the calibrated target temperature. In accordance with the present techniques, re-calibration of the calibrated target temperature and reference run time may improve efficient operation of the HVAC system 150. For example, the updated calibrated target temperature and updated reference run time may reflect changes associated with operation of the HVAC system 150 in the variable operating mode and/or the conditioned space since the previous call has been output from the thermostat 156. Indeed, the updated calibrated target temperature and updated reference run time may replace the previously determined calibrated target temperature and reference run time, respectively, and the primary control circuitry 154 may operate the HVAC system 150 in the variable operating mode based on the updated calibrated target temperature and updated reference run time in response to subsequent calls for conditioning.

Additionally, it should be noted that, at block 196, a determination may be made that the call output by the thermostat 156 is not a first stage call. For example, the call output by the thermostat 156 may be a second stage call indicative of increased operation of the HVAC system 150. For instance, the second stage call, instead of a first stage call, may be output based on an increased demand for conditioning via the HVAC system 150, such as based on a change in a setpoint temperature of the space. As a result, a previously determined calibrated target temperature used for operating the HVAC system 150 in the variable operating mode may not be used to enable operation of the HVAC system 150 to satisfy the second stage call. In response to a determination that the call output by the thermostat 156 is a second stage call, the predetermined temperature reference value may be transmitted to the primary control circuitry 154, as described with reference to block 208. The predetermined temperature reference value may cause the primary control circuitry 154 to operate the HVAC system 150 in the increased operation (e.g., an increased capacity) in the variable operating mode to satisfy the second stage call. After the second stage call is satisfied, the HVAC system 150 may be operated in the calibration mode to determine an updated calibrated target temperature and updated reference run time for operating the HVAC system 150 in the variable operating mode. In such circumstances, the updated calibrated target temperature may enable the HVAC system 150 to operate more efficiently in the variable operating mode to satisfy a subsequent call for conditioning (e.g., to prompt a subsequent first stage call and/or avoid a subsequent second stage call).

Figure 7:
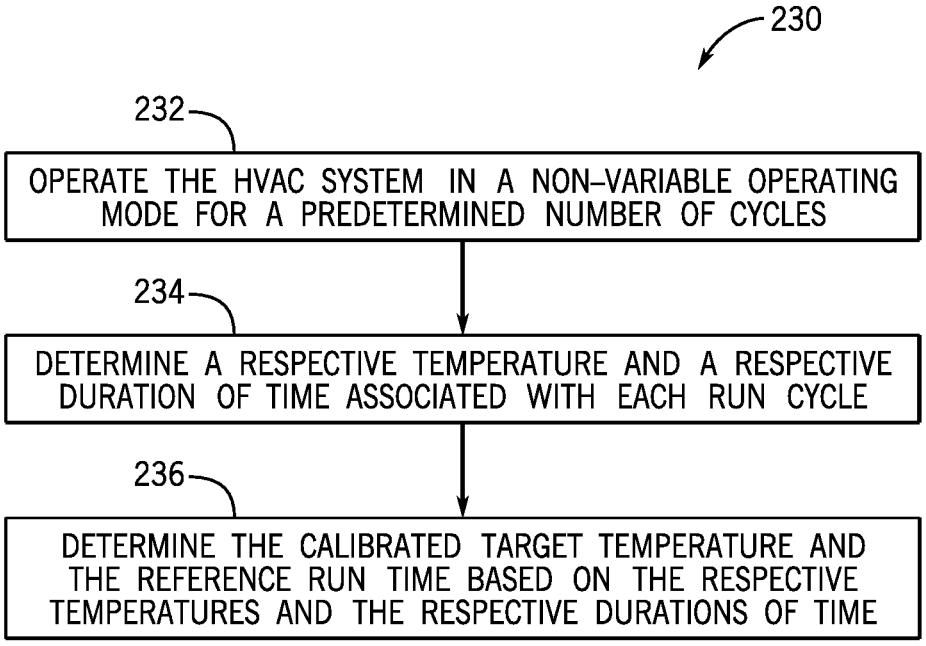
FIG. 7 is a flowchart of an embodiment of a method or process for operating an HVAC system in a calibration mode, in accordance with an aspect of the present disclosure.

FIG. 7 is a flowchart of an embodiment of a method or process 230 for operating the HVAC system 150 in the calibration mode (e.g., via the secondary control circuitry 160) to determine the calibrated target temperature and reference run time to be provided to the primary control circuitry 154 to operate the HVAC system 150 in the variable operating mode. At block 232, the HVAC system 150 is operated in a non-variable operating mode for a predetermined number of run cycles to satisfy a respective call associated with each run cycle. That is, the HVAC system 150 may be operated in the non-variable operating mode to satisfy calls for conditioning until the predetermined number of run cycles have been completed. As an example, the HVAC system 150 may be operated in the non-variable operating mode for three run cycles (e.g., to satisfy three calls for conditioning), four run cycles (e.g., to satisfy four calls for conditioning), or five or more cycles (e.g., to satisfy five or more calls for conditioning).

The non-variable operating mode may include a single operating mode or capacity at which the HVAC system 150 operates. That is, the operating capacity of the HVAC system 150 may not be adjusted upon initiating operation in the non-variable operating mode until the associated call for conditioning has been satisfied. After the call for conditioning has been satisfied, operation of the HVAC system 150 in the non-variable operating mode may be suspended until a subsequent call for conditioning has been output by the thermostat 156. The HVAC system 150 may be operated in the same non-variable operating mode during each run cycle of the calibration mode regardless of the type of call for conditioning output by the thermostat 156. For example, the compressor 74 may be operated at the same capacity regardless of whether a first stage call or a second stage call has been output. In some embodiments, the non-variable operating mode may include a maximum or upper threshold operation (e.g., a full speed or capacity operation, a second stage operating mode) to satisfy each call output by the thermostat 156 in the calibration mode. In additional or alternative embodiments, the non-variable operating mode may include a different operating mode (e.g., a first stage operating mode) to satisfy calls for conditioning in the calibration mode.

At block 234, a respective temperature value and a respective duration of time associated with each run cycle in the calibration mode may be determined. The respective temperature value may be representative of a setpoint or target temperature of the space. For example, the respective temperature values may each include a temperature value of return air directed from the space to the HVAC system 150 at an end or conclusion of the associated run cycle. Such a temperature may include a final recorded temperature, a temperature recorded or determined immediately prior to (e.g., within a threshold period of time prior to) suspending operation of the non-variable operating mode, and/or a temperature recorded or determined immediately after (e.g., within a threshold period of time after) suspending operation of the non-variable operating mode. As such, the temperature value may be indicative of the temperature of the space when the call for conditioning is satisfied. In certain embodiments, the temperature value may be received from the sensor(s) 158. Additionally, the respective duration of time may indicate an amount of time in which the HVAC system 150 is in operation in the non-variable operating mode to satisfy the call associated with the run cycle. To this end, a timer may be activated to monitor the duration of time upon initiation of the HVAC system 150 in the non-variable operating mode, and the timer may stop after operation of the HVAC system 150 in the non-variable operating mode is suspended (e.g., based on the call for conditioning being satisfied).

At block 236, the calibrated target temperature and the reference run time may be determined based on the respective temperature values and the respective durations of time determined in the step described with respect to block 234. In certain embodiments, the calibrated target temperature may be determined based on an average (e.g., a mathematical mean, a mathematical median) of the respective temperature values, and/or the reference run time may be determined based on an average (e.g., a mathematical mean, a mathematical median) of the respective durations of time. In additional or alternative embodiments, the calibrated target temperature and/or the reference run time may be determined in a different manner based on the respective temperature values and the respective durations of time. For example, a different equation may be applied to the respective temperature values and/or the respective durations of time to determine the calibrated target temperature and/or the reference run time, respectively, and/or an offset or other adjustment factor may be applied to the respective temperature values and/or the respective durations of time to determine the calibrated target temperature and/or the reference run time, respectively.

The present disclosure may provide one or more technical effects useful in the operation of an HVAC system. For example, the HVAC system may include primary control circuitry configured to operate components of the HVAC system, such as a compressor and/or a furnace system, to condition a space serviced by the HVAC system. The primary control circuitry may be communicatively coupled to a thermostat and may operate the HVAC system based on one or more signals transmitted by the thermostat. Certain embodiments of the thermostat, such as communicating thermostats, may transmit signals that enables the primary control circuitry to operate the HVAC system in a variable operating mode to condition the space. However, other embodiments of the thermostat, such as conventional, switching, and/or non-communicating thermostats, may transmit signals that do not alone enable the primary control circuitry to operate the HVAC system in the variable operating mode. For example, signals transmitted by conventional thermostats may not indicate certain information typically used by the primary control circuitry to operate the HVAC system in the variable operating mode. For this reason, the HVAC system may include secondary control circuitry that may determine and transmit additional information to the primary control circuitry to enable operation of the HVAC system in the variable operating mode. As an example, the secondary control circuitry may determine the additional information via operation of the HVAC system in a calibration mode. As another example, the secondary control circuitry may transmit predetermined additional information to the primary control circuitry. The primary control circuitry may then operate the HVAC system in the variable operating mode based on the additional information received from the secondary control circuitry. As such, the secondary control circuitry may enable the primary control circuitry to operate the HVAC system in the variable operating mode using signals transmitted by thermostats of different types. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A control system for a heating, ventilation, and/or air conditioning (HVAC) system, comprising:

primary control circuitry configured to operate the HVAC system in a variable operating mode based on data received from a first type of thermostat; and secondary control circuitry configured to communicatively couple to the primary control circuitry, wherein, in response to a determination that a thermostat communicatively coupled to the secondary control circuitry is a second type of thermostat different from the first type of thermostat, the secondary control circuitry is configured to transmit additional data to the primary control circuitry to enable operation of the HVAC system in the variable operating mode via the primary control circuitry and based on the additional data, wherein the control system is configured to determine that the thermostat is the first type of thermostat or the second type of thermostat.

2. The control system of claim 1, wherein the primary control circuitry is configured to receive a signal from the thermostat, and the primary control circuitry is configured to determine that the thermostat is the first type of thermostat or the second type of thermostat based on the signal.

3. The control system of claim 1, wherein the secondary control circuitry is configured to receive a signal from the thermostat, and the secondary control circuitry is configured to determine that the thermostat is the first type of thermostat or the second type of thermostat based on the signal.

4. The control system of claim 1, wherein the first type of thermostat is a communicating thermostat, and the second type of thermostat is a non-communicating thermostat or a conventional thermostat.

5. The control system of claim 1, wherein the additional data comprises a calibrated target temperature and a reference run time.

6. The control system of claim 5, wherein the control system is configured to operate the HVAC system in a calibration mode to determine the calibrated target temperature and the reference run time, and wherein the control system is configured to operate the HVAC system in a non-variable operating mode during the calibration mode.

7. The control system of claim 6, wherein, in the calibration mode, the control system is configured to:

operate the HVAC system in the non-variable operating mode for a predetermined number of run cycles;

determine the calibrated target temperature based on a respective temperature value associated with each run cycle of the predetermined number of run cycles; and determine the reference run time based on a respective duration of time value associated with each run cycle of the predetermined number of run cycles.

8. The control system of claim 5, wherein the secondary control circuitry is configured to:

monitor a duration of time associated with operation of HVAC system in the variable operating mode;

compare the duration of time to the reference run time; and in response to a determination that the duration of time exceeds the reference run time by a threshold period of time, transmit a predetermined temperature reference value to the primary control circuitry to enable operation of the HVAC system in the variable operating mode via the primary control circuitry based on the predetermined temperature reference value.

9. The control system of claim 1, wherein, in response a determination that the thermostat is the first type of thermostat, the secondary control circuitry is configured to not transmit the additional data to the primary control circuitry.

10. A non-transitory computer-readable medium comprising instructions stored thereon, wherein the instructions, when executed by processing circuitry, are configured to cause the processing circuitry to:

determine that a thermostat of a heating, ventilation, and/or air conditioning (HVAC) system communicatively coupled to the processing circuitry is a first type of thermostat or a second type of thermostat, wherein the first type of thermostat is configured to provide select data, and the second type of thermostat is not configured to provide the select data;

in response to a determination that the thermostat is the first type of thermostat, operate the HVAC system in a variable operating mode based on the select data received from the thermostat; and in response to a determination that the thermostat is the second type of thermostat, operate the HVAC system in the variable operating mode based on additional data stored on the non-transitory computer-readable medium instead of the select data.

11. The non-transitory computer-readable medium of claim 10, wherein the instructions, when executed by the processing circuitry, are configured to cause the processing circuitry to determine that the thermostat of the HVAC system communicatively coupled to the processing circuitry is the first type of thermostat or the second type of thermostat based on a signal received by the processing circuitry from the thermostat or based on a user input received by the processing circuitry.

12. The non-transitory computer-readable medium of claim 10, wherein the additional data comprises a calibrated target temperature and a reference run time, and the instructions, when executed by the processing circuitry, are configured to cause the processing circuitry to operate the HVAC system in the variable operating mode based on the calibrated target temperature and the reference run time in response to a determination that a signal transmitted by the thermostat is indicative of a first stage call for conditioning.

13. The non-transitory computer-readable medium of claim 12, wherein the instructions, when executed by the processing circuitry, are configured to cause the processing circuitry to:

monitor a duration of time associated with operation of the HVAC system in the variable operating mode based on the calibrated target temperature and the reference run time;

compare the duration of time to the reference run time; and in response to a determination that the duration of time exceeds the reference run time by a threshold period of time, operate the HVAC system in the variable operating mode based on a predetermined temperature reference value instead of based on the calibrated target temperature.

14. The non-transitory computer-readable medium of claim 10, wherein the additional data comprises a predetermined temperature reference value, and the instructions, when executed by the processing circuitry, are configured to cause the processing circuitry to operate the HVAC system in the variable operating mode based on the predetermined temperature reference value in response to a determination that a signal transmitted by the thermostat is indicative of a second stage call for conditioning.

15. The non-transitory computer-readable medium of claim 10, wherein the additional data comprises a calibrated target temperature and a reference run time, and the instructions, when executed by the processing circuitry, are configured to cause the processing circuitry to:

operate the HVAC system in a non-variable operating mode for a predetermined number of run cycles in a calibration mode of the HVAC system;

determine the calibrated target temperature based on a respective temperature value associated with each run cycle of the predetermined number of run cycles; and determine the reference run time based on a respective duration of time value associated with each run cycle of the predetermined number of run cycles.

16. The non-transitory computer-readable medium of claim 15, wherein the respective temperature value associated with each run cycle is an air temperature value detected at an end of the run cycle.

17. A control system comprising a non-transitory computer-readable medium comprising instructions stored thereon and processing circuitry configured to execute the instructions, wherein the control system is configured to:

operate a heating, ventilation, and/or air conditioning (HVAC) system in a variable operating mode based on select data;

determine that a thermostat of the HVAC system communicatively coupled to the processing circuitry is not configured to provide the select data; and in response to the determination that the thermostat is not configured to provide the select data, operate the HVAC system in the variable operating mode based on additional data stored on the non-transitory computer-readable medium instead of the select data, wherein the additional data comprises calibrated data determined via operation of the HVAC system in a calibration mode, predetermined data, or both.

18. The control system of claim 17, wherein the control system is configured to:

receive a signal from the thermostat indicative of a call for conditioning, and in response to a determination that the call for conditioning is a first stage call for conditioning, operate the HVAC system in the variable operating mode based on the calibrated data, wherein the calibrated data comprises a calibrated target temperature and a reference run time.

19. The control system of claim 17, wherein the control system is configured to:

receive a signal from the thermostat indicative of a call for conditioning, and in response to a determination that the call for conditioning is a second stage call for conditioning, operate the HVAC system in the variable operating mode based on the predetermined data, wherein the predetermined data comprises a predetermined temperature reference value.

20. The control system of claim 17, wherein the control system is configured to operate the HVAC system in the calibration mode, and, in the calibration mode, the control system is configured to:

operate the HVAC system in a non-variable operating mode in each run cycle of a predetermined number of run cycles;

determine a calibrated target temperature of the calibrated data based on a respective temperature value associated with each run cycle of the predetermined number of run cycles; and determine a reference run time of the calibrated data based on a respective duration of time value associated with each run cycle of the predetermined number of run cycles.

* * * * *